US006315683B1

(12) United States Patent
Yoshida et al.

(10) Patent No.: US 6,315,683 B1
(45) Date of Patent: Nov. 13, 2001

(54) HOLLOW SOLID GOLF BALL

(75) Inventors: Kazunari Yoshida, Kasai; Mikio Yamada, Kobe, both of (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

(21) Appl. No.: 09/496,269

(22) Filed: Feb. 1, 2000

(30) Foreign Application Priority Data

Feb. 1, 1999 (JP) ..... 11-023752

(51) Int. Cl.[7] ..... A63B 37/04; A63B 37/06; A63B 37/02; A63B 39/00

(52) U.S. Cl. ..... 473/375; 473/358

(58) Field of Search ..... 473/351, 355, 473/358, 375, 609

(56) References Cited

U.S. PATENT DOCUMENTS

| | | | | |
|---|---|---|---|---|
| 1,202,318 | * | 10/1916 | Roberts | 473/367 |
| 1,402,682 | * | 1/1922 | Takashima | 156/145 |
| 5,273,287 | | 12/1993 | Molitor et al. . | |
| 5,368,304 | | 11/1994 | Sullivan et al. . | |
| 5,433,447 | | 7/1995 | Pocklington . | |
| 5,738,597 | | 4/1998 | Sullivan et al. . | |
| 5,944,621 | * | 8/1999 | Tsujinaka et al. | 473/369 |
| 5,980,395 | * | 11/1999 | Tsunoda et al. | 473/373 |
| 5,997,416 | * | 12/1999 | Maruko | 473/371 |
| 6,004,225 | * | 12/1999 | Owens et al. | 473/372 |
| 6,120,393 | * | 9/2000 | Sullivan et al. | 473/377 |
| 6,126,560 | * | 10/2000 | Maruoka et al. | 473/409 |
| 6,182,970 | * | 2/2001 | Fushihara et al. | 273/375 |
| 6,200,231 | * | 3/2001 | Moriyama et al. | 473/358 |

FOREIGN PATENT DOCUMENTS

| | | | |
|---|---|---|---|
| 0846478A1 | | 6/1998 | (EP) . |
| 4371170 | | 12/1992 | (JP) . |
| 6114123 | | 4/1994 | (JP) . |
| 6312032 | | 11/1994 | (JP) . |
| 880360 | | 3/1996 | (JP) . |
| A-10127815 | | 5/1998 | (JP) . |
| A-10211301 | | 8/1998 | (JP) . |
| 09308709-A | * | 12/1997 | (JP) ..... A63B/37/00 |

* cited by examiner

*Primary Examiner*—Jeanette Chapman
*Assistant Examiner*—Alvin A. Hunter, Jr.
(74) *Attorney, Agent, or Firm*—Birch, Stewart, Kolasch & Birch, LLP

(57) ABSTRACT

The present invention provides a hollow solid golf ball having excellent flight performance and soft and good shot feel at the time of hitting. The present invention relates to a hollow solid golf ball comprising a core having a hollow portion at the center of the core and a cover formed on the core, wherein the golf ball has a diameter of 42.92 to 45.47 mm, a moment of inertia of 83 to 105 g·cm$^2$, and a deformation amount of 2.6 to 4.0 mm, when applying from an initial load of 10 kgf to a final load of 130 kgf.

5 Claims, 2 Drawing Sheets

HOLLOW SOLID GOLF BALL

FIELD OF THE INVENTION

The present invention relates to a hollow solid golf ball having excellent flight performance and soft and good shot feel at the time of hitting.

BACKGROUND OF THE INVENTION

With respect to the size (diameter) of golf balls, a diameter of not less than 1.680 inches (42.67 mm) is limited by a standard established by USGA (United States Golf Association) rule. Generally, when the diameter of the golf ball is large, air resistance of the golf ball on a flight is large, which reduces the flight distance. Therefore, most of golf balls which have been commercially available are designed to reduce its diameter to the lower limit of the standard as long as possible. The golf ball, of which the diameter is approached to the lower limit of the standard, is called as a standardized ball.

Although it is disadvantage in flight distance that the larger the ball size, the larger the air resistance when the ball is traveling, the larger sized golf ball has an advantage in that one feels one's target larger and easier to hit the ball with a sweet spot of a golf club, even in mental feeling. It is also known that when the larger sized golf ball is hit, the golf ball has large moment of inertia and is superior in straightness and retention of spin. The golf balls having a larger diameter (hereinafter called as "over-size golf ball") in order to obtain the advantage are described in, for example, Japanese Patent Kokai Publication Nos. 371170/1992, 114123/1994, 312032/1994, 80360/1996, 211301/1998 and the like.

In Japanese Patent Kokai Publication No. 211301/1998, an over-size golf ball having a suitable hardness and thickness of cover is described. In Japanese Patent Kokai Publication Nos. 371170/1992, 114123/1994, 312032/1994 and 80360/1996, over-size golf balls having an adjusted ratio of dimple area to surface area of the golf ball are described. In the golf balls described above, it is attempted to improve flight distance by adjusting the hardness and thickness of cover and the ratio of dimple area to surface area of the golf ball to a proper range, in combination with enlarging the diameter. However, when considering the reduction of the flight distance by increasing air resistance because of the enlargement of the diameter, the technical effect of extending the flight distance is not sufficiently obtained, and it is required to improve more. In other words, when an over-size golf ball is produced merely by enlarging a size of a standardized golf ball, an air resistance to the traveling golf ball is too much and severely reduces its flight distance. Accordingly, it is not sufficient to merely improve a standardized golf ball for obtaining an over-size golf ball.

On the other hand, the present inventors have developed a hollow solid golf ball having a hollow portion in a core (Japanese Patent Kokai Publication No. 127815/1998). Solid golf balls having no hollow portion have hard and poor shot feel and are not generally approved of or employed by professional golfers and the like. In order to improve the shot feel, it is effective to soften the solid core, but it is a drawback that the rebound characteristics are degraded, and reduces the flight distance. In order to improve the drawback, the present inventors have proposed the hollow solid golf ball having a hollow portion at the center of a core. Since the hollow solid golf ball comprises the hollow portion therein, (1) an impact force at the time of hitting is small, and shot feel is good, and (2) a moment of inertia is large, thus spin amount immediately after hitting is small, and retention of spin is large after the golf ball passes the highest point of the flight curve of the golf ball, which improves the flight distance. That is, the hollow solid golf ball is superior in both shot feel and flight distance.

OBJECTS OF THE INVENTION

As described above, the attempt to obtain the over-size golf ball have been mostly failed. In the present invention, however, the present inventors have introduced the concept of hollow golf balls into over-size golf balls and have adjusted a moment of inertia and deformation amount to solve the problems of the conventional over-size golf balls.

A main object of the present invention is to provide an over-size hollow solid golf ball having excellent flight performance and soft and good shot feel at the time of hitting.

According to the present invention, the object described above has been accomplished by placing a hollow portion in a core and adjusting a moment of inertia and deformation amount to a specified range, thereby providing an over-size hollow solid golf ball having excellent flight performance and soft and good shot feel at the time of hitting.

This object as well as other objects and advantages of the present invention will become apparent to those skilled in the art from the following description with reference to the accompanying drawings.

BRIEF EXPLANATION OF DRAWINGS

The present invention will become more fully understood from the detailed description give hereinbelow and the accomplishing drawings, which are given by way of illustrating only, and thus are not limitative of the present invention, and wherein.

SUMMARY OF THE INVENTION

Figure 1:
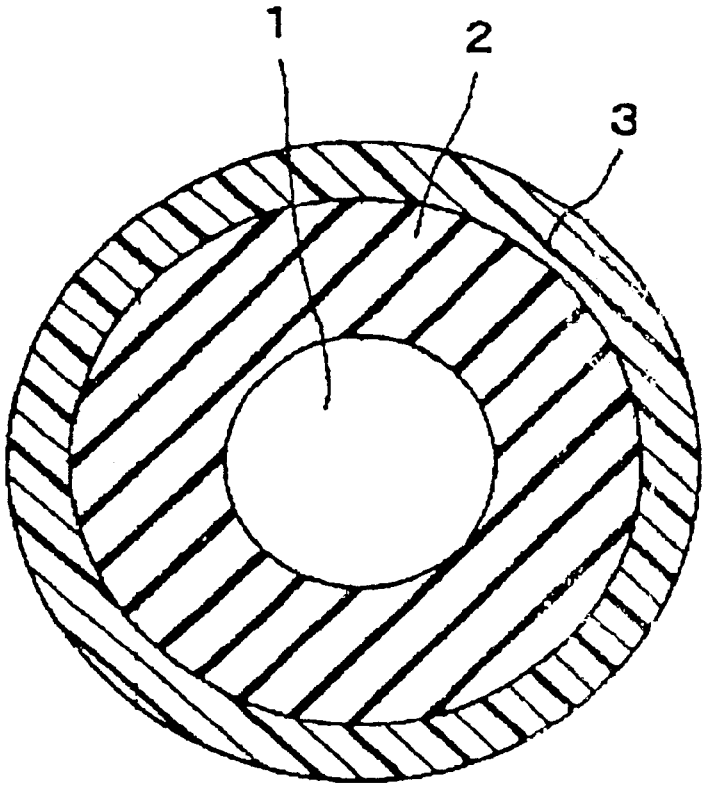
FIG. 1 is a schematic cross section illustrating one embodiment of the golf ball of the present invention.

The present invention provides a hollow solid golf ball comprising a core having a hollow portion at the center of the core and a cover formed on the core, wherein the golf ball has a diameter of 42.92 to 45.47 mm, a moment of inertia of 83 to 105 $g \cdot cm^2$, and a deformation amount of 2.6 to 4.0 mm, when applying from an initial load of 10 kgf to a final load of 130 kgf.

It is required that the over-size hollow solid golf ball of the present invention has a diameter of 42.92 to 45.47 mm. In hollow golf balls, a load (concentration of stress) applied to a core and cover at the time of hitting tends to be large because of the presence of a hollow portion therein. In order to reduce the load, it is preferable that the diameter of the golf ball is large. Therefore the diameter is preferably not less than 43.18 mm, more preferably not less than 43.50 mm, most preferably not less than 43.60 mm. When the diameter is larger than 45.47 mm, air resistance is large, which reduces the flight distance, and the golf ball is not accepted in the market. Therefore the diameter is preferably not more than 44.70 mm, more preferably not more than 44.20 mm.

It is required that the over-size hollow solid golf ball of the present invention has a moment of inertia of 83 to 105 $g \cdot cm^2$. As described above, in the over-size golf ball, air resistance on a flight is large, which reduces the flight distance. On the other hand, in the over-size hollow solid golf ball of the present invention, the moment of inertia is large because of the presence of a hollow portion therein, which can extend the flight distance. Therefore the moment of inertia is preferably not less than 85 $g \cdot cm^2$. In order to enlarge the moment of inertia, it is required to use a large amount of filler in the outer portion of the golf ball, such as a cover, and the durability or productivity is degraded. Therefore the moment of inertia is preferably not more than 100 $g \cdot cm^2$, more preferably not more than 88 $g \cdot cm^2$.

It is required that the over-size hollow solid golf ball of the present invention has a deformation amount of 2.6 to 4.0 mm, when applying from an initial load of 10 kgf to a final load of 130 kgf. In the hollow solid golf ball, the shot feel is good because of the presence of the hollow portion therein, but when the deformation amount is too small, the shot feel is poor. Therefore the deformation amount is preferably not less than 2.7 mm. On the other hand, when the deformation amount is too large, the rebound characteristics are degraded. Therefore the deformation amount is preferably not more than 3.8 mm, more preferably not more than 3.5 mm, most preferably not more than 3.3 mm.

In order to practice the present invention suitably, it is desired that the cover of the over-size hollow solid golf ball of the present invention have a Shore D hardness of 50 to 64 and a thickness of 1.0 to 2.1 mm. When the cover hardness is too small, the spin amount is large, which reduces the flight distance. Therefore the hardness is preferably not less than 55, more preferably not less than 57. When the cover thickness is smaller than 1.0 mm, the rebound characteristics and durability are degraded. On the other hand, when the thickness is larger than 2.1 mm, the shot feel is hard and poor.

DETAILED DESCRIPTION OF THE INVENTION

The golf ball of the present invention will be explained in detail hereinafter with reference to the accompanying drawings. FIG. 1 is a schematic cross section illustrating one embodiment of the golf ball of the present invention. As shown in FIG. 1, the golf ball of the present invention comprises a core 2 having a hollow portion 1 at the center of the core and a cover 3 formed on the core.

As the diameter of the hollow portion 1 is large, the golf ball, of which the moment of inertia is large, can be obtained, but a ratio of a layer of an vulcanized molded article of rubber composition, which has restitution modulus in the core, is small. Therefore it is preferable that the diameter of the hollow portion 1 is 5 to 20 mm, preferably 5 to 22 mm. When the diameter of the hollow portion is larger than 20 mm, the layer of rubber composition is too thin, and it is required to use a large amount of filler in the layer for adjusting a specific gravity, which degrades the rebound characteristics. On the other hand, when the diameter is smaller than 5 mm, the technical effect accomplished by the presence of the hollow portion is not be obtained.

It is preferable that the core 2 of the golf ball of the present invention is formed from a vulcanized molded article of a rubber composition comprising polybutadiene, a co-crosslinking agent, an organic peroxide, an organic sulfide compound and a filler.

The polybutadiene used for the core 2 of the present invention may be one, which has been conventionally used for cores of solid golf balls. Preferred is high-cis polybutadiene rubber containing a cis-1, 4 bond of not less than 40%, preferably not less than 80%. The high-cis polybutadiene rubber may be optionally mixed with natural rubber, polyisoprene rubber, styrene-butadiene rubber, ethylene-propylene-diene rubber (EPDM).

The co-crosslinking agent can be a metal salt of α,β-unsaturated carboxylic acid, including mono or divalent metal salts, such as zinc or magnesium salts of α,β-unsaturated carboxylic acids having 3 to 8 carbon atoms (e.g. acrylic acid, methacrylic acid, etc.). Preferred is zinc acrylate because it imparts high rebound characteristics to the resulting golf ball. The amount of the co-crosslinking agent is 10 to 50 parts by weight, preferably 20 to 40 parts by weight, based on 100 parts by weight of the polybutadiene. When the amount of the co-crosslinking agent is larger than 50 parts by weight, the core is too hard, and the shot feel is poor. On the other hand, when the amount of the co-crosslinking agent is smaller than 10 parts by weight, it is required to increase the amount of the organic peroxide in order to impart a desired hardness to the core. Therefore, the rebound characteristics are degraded, which reduces the flight distance.

The organic peroxide, which acts as a crosslinking agent or hardener, includes, for example, dicumyl peroxide, 1,1-bis (t-butylperoxy)-3,3,5-trimethylcyclohexane, 2,5-dimethyl-2,5-di(t-butylperoxy) hexane, di-t-butyl peroxide and the like. Preferred is dicumyl peroxide. The amount of the organic peroxide is 0.3 to 2.0 parts by weight, preferably 0.4 to 1.5 parts by weight, based on 100 parts by weight of the polybutadiene. When the amount of the organic peroxide is smaller than 0.3 parts by weight, the core is too soft, and the rebound characteristics are degraded, which reduces the flight distance. On the other hand, when the amount of the organic peroxide is larger than 2.0 parts by weight, it is required to decrease the amount of the co-crosslinking agent in order to impart a desired hardness to the core. Therefore, the rebound characteristics are degraded, which reduces the flight distance.

In the hollow solid golf ball, the flight distance can be improved because of large moment of inertia, but the rebound characteristics tend to be degraded because of the presence of the hollow portion. The rebound characteristics can be improved by using the organic sulfide compound in the core, and the flight distance can be very long in combination with the technical effect accomplished by increasing the moment of inertia.

The organic sulfide compound used for the over-size hollow solid golf ball of the present invention includes thiophenols, such as pentachlorothiophenol, pentafluorothiophenol, 4-chlorothiophenol, 4-bromothiophenol, 4-fluorothiophenol, 4-t-butyl-o-thiophenol, 4-t-butylthiophenol, 2,3-dichlorothiophenol, 2,4-dichlorothiophenol, 2,5-dichlorothiophenol, 2,6-dichlorothiophenol, 3,4-dichlorothiophenol, 3,5-dichlorothiophenol, 2,4,5-trichlorothiophenol, thiosalicylic acid, methylthiosalicylic acid, o-toluenethiol, m-toluenethiol, p-toluenethiol, 3-aminothiophenol, 4-aminothiophenol, 3-methoxythiophenol, 4-methoxythiophenol, 4-mercaptphenyl sulfide, 2-benzamidothiophenol and the like; thiocarboxylic acids, such as thioacetic acid, thiobenzoic acid and the like; disulfides, such as diphenyl disulfide, bis(2-aminophenyl) disulfide, bis(4-aminophenyl) disulfide, bis(4-hydroxphenyl) disulfide, bis(4-methylphenyl) disulfide, bis (4-t-butylphenyl) disulfide, bis(2-benzamidophenyl) disulfide, dixylyl disulfide, di(o-benzamidophenyl) disulfide, dimorpholino disulfide, bis(4-chlorophenyl) disulfide, bis(2,5-dichlorophenyl) disulfide, bis(3,5-dichlorophenyl) disulfide, bis(2,4,5-trichlorophenyl) disulfide, bis(2-cyanophenyl) disulfide, bis(2-nitrophenyl)

disulfide, bis(4-nitrophenyl) disulfide, bis(2,4-dinitrophenyl) disulfide, 2,2-dithio dibenzoic acid, 5,5-dithiobis(2-nitrobenzoic acid), bis(pentafluorophenyl) disulfide, dibenzyl disulfide, di-t-dodecyl disulfide, diallyl disulfide, difurfuryl disulfide, 2,2-dibenzothiazoryl disulfide, bis(2-naphthyl) disulfide, bis(4-mercaptphenyl) disulfide, 4-(2-benzothiazoryldithio)morpholine, 2,2-dipyridinyl disulfide, 2,2-dithiobis(5-nitropyridine), 2,2-dithiodianiline, 4,4-dithiodianiline, 2,4-dinitrophenylsulfenyl chloride, dithiodiglycolic acid, 4,4'-dithiodimorpholine, L-cystine and the like; thiurams, such as tetramethylthiuram disulfide, tetraethylthiuram disulfide, tetrabutylthiuram disulfide, tetramethylthiuram monosulfide, N,N'-dimethyl-N,N'-diphenylthiuram disulfide, dipentamethylenethiuram tetrasulfide and the like; thiazoles, such as 2-mercaptbenzothiazole, 2-mercaptbenzothiazole sodium salt, 2-mercaptbenzothiazole zinc salt, 2-mercaptbenzothiazole dicyclohexylamine salt, 2-(N,N-diethylcarbamylthio) benzothiazole, 2-(4'-morphorinodithio)benzothiazole, 2,5-dimercapt-1,3,4-thiadiazole, Bismuthiol I, Bismuthiol II, 2-amino-5-mercapt-1,3,4-thiadiazole, trithiocyanuric acid and the like; sulfenamides; thioureas; dithiocarbamates; and the like. Preferred are disulfides, particularly diphenyl disulfide, in view of the technical effect of improving rebound characteristics and its cheapness.

The amount of the organic sulfide compound is 0.2 to 3.0 parts by weight, preferably 0.3 to 1.5 parts by weight, more preferably 0.4 to 1 parts by weight, based on 100 parts by weight of the polybutadiene. When the amount is smaller than 0.2 parts by weight, the technical effect of improving the rebound characteristics by using the organic sulfide compound is sufficiently obtained. On the other hand, when the amount is larger than 3.0 parts by weight, vulcanization rate is too small, and vulcanization time is long.

The filler, which can be typically used for the core of solid golf ball, includes for example, inorganic filler (such as zinc oxide, barium sulfate, calcium carbonate, magnesium oxide and the like), high specific gravity metal powder filler (such as tungsten powder, molybdenum powder and the like), and mixtures thereof. The amount of the filler is 3 to 30 parts by weight, preferably 3 to 20 parts by weight, based on 100 parts by weight of the polybutadiene. When the amount of the filler is smaller than 3 parts by weight, it is difficult to adjust the weight of the resulting golf ball, and vulcanization of the rubber composition is sufficiently conducted. On the other hand, when the amount of the filler is larger than 30 parts by weight, the weight ratio of the rubber component in the core is small, and the rebound characteristics are degraded too much.

The rubber composition for the core of the golf ball of the present invention can contain other components, which have been conventionally used for preparing the core of solid golf balls, such as antioxidant. If used, the amount of the antioxidant is preferably 0.1 to 1.0 parts by weight, based on 100 parts by weight of the polybutadiene.

Figure 2:
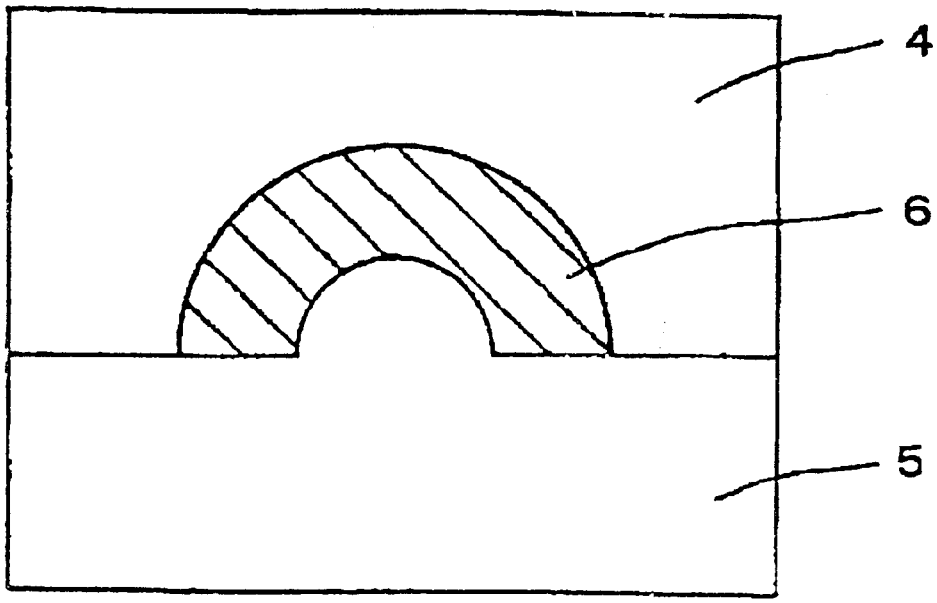
FIG. 2 is a schematic cross section illustrating one embodiment of a mold for molding a semi-spherical half-shell for a core of the golf ball of the present invention.
Figure 3:
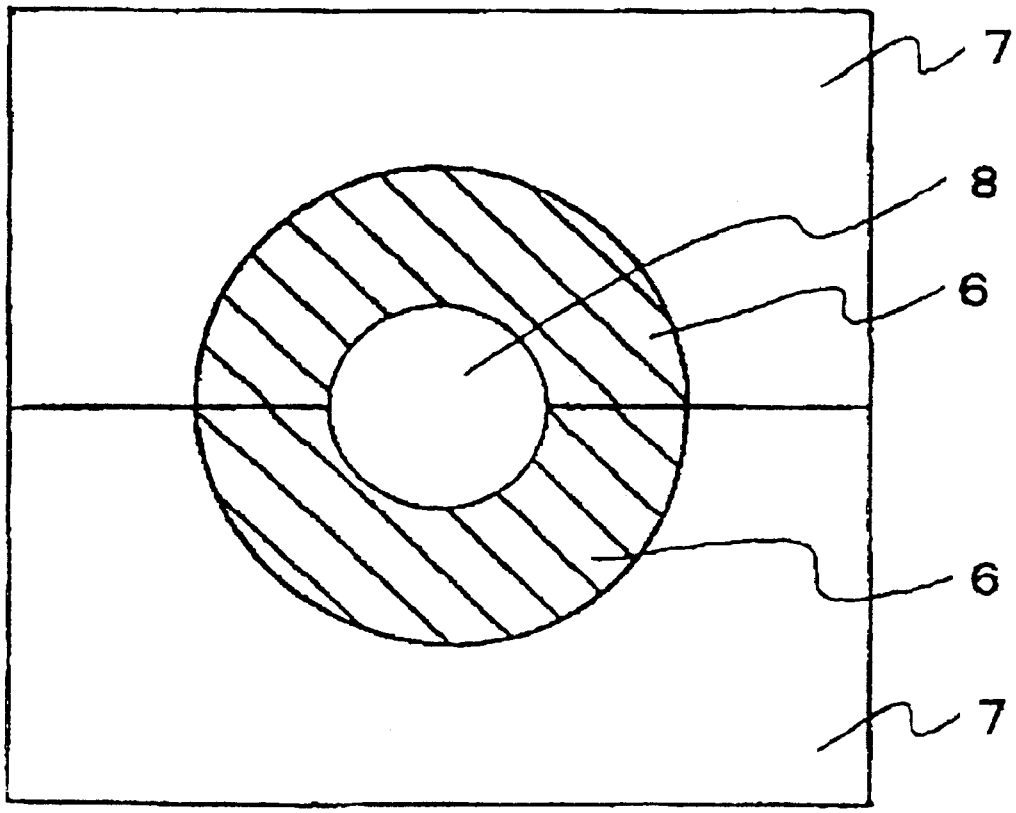
FIG. 3 is a schematic cross section illustrating one embodiment of a mold for molding a core of the golf ball of the present invention.

The process of producing the core 2 of the golf ball of the present invention will be explained with reference to FIG. 2 and FIG. 3. FIG. 2 is a schematic cross section illustrating one embodiment of a mold for molding a semi-vulcanized semi-spherical half-shell for a core used for the golf ball of the present invention. FIG. 3 is a schematic cross section illustrating one embodiment of a mold for molding a core of the golf ball of the present invention. The rubber composition for the core is mixed, and press-molded at 120 to 160° C. for 10 seconds to 10 minutes using a mold having a semi-spherical cavity 4 and a male plug mold 5 having a semi-spherical convex having the same diameter as the hollow portion as described in FIG. 2 to obtain a semi-vulcanized semi-spherical half-shell 6 for the core. The two semi-vulcanized semi-spherical half-shells 6 for the core is vulcanized by press-molding at 140 to 170° C. for 10 to 50 minutes in a mold 7 as described in FIG. 3 to prepare a spherical core 2 having a hollow portion 8. The cover 3 is then covered on the core 2.

The cover 3 of the present invention contains thermoplastic resin, particularly ionomer resin, which has been conventionally used for the cover of golf balls, as a base resin. The ionomer resin may be a copolymer of ethylene and α,β-unsaturated carboxylic acid having 3 to 8 carbon atoms, of which a portion of carboxylic acid groups is neutralized with metal ion, or a terpolymer of ethylene, α,β-unsaturated carboxylic acid and α,β-unsaturated carboxylic acid ester, of which a portion of carboxylic acid groups is neutralized with metal ion. Examples of the α,β-unsaturated carboxylic acid in the ionomer include acrylic acid, methacrylic acid, fumaric acid, maleic acid, crotonic acid and the like, preferred are acrylic acid and methacrylic acid. Examples of the α,β-unsaturated carboxylic acid ester in the ionomer include methyl ester, ethyl ester, propyl ester, n-butyl ester and isobutyl ester of acrylic acid, methacrylic acid, fumaric acid, maleic acid and the like. Preferred are acrylic acid esters and methacrylic acid esters. The metal ion which neutralizes a portion of carboxylic acid groups of the copolymer or terpolymer includes a sodium ion, a potassium ion, a lithium ion, a magnesium ion, a calcium ion, a zinc ion, a barium ion, an aluminum, a tin ion, a zirconium ion, cadmium ion, and the like. Preferred are sodium ions, zinc ions, magnesium ions and the like, in view of rebound characteristics, durability and the like.

The ionomer resin is not limited, but examples thereof will be shown by a trade name thereof. Examples of the ionomer resins, which are commercially available from Mitsui Du Pont Polychemical Co., Ltd. include Hi-milan 1555, Hi-milan 1557, Hi-milan 1605, Hi-milan 1652, Hi-milan 1702, Hi-milan 1705, Hi-milan 1706, Hi-milan 1707, Hi-milan 1855, Hi-milan 1856 and the like. Examples of the ionomer resins, which are commercially available from Du Pont Co., include Surlyn 8945, Surlyn 9945, Surlyn AD8511, Surlyn AD8512, Surlyn AD8542 and the like. Examples of the ionomer resins, which are commercially available from Exxon Chemical Co., include Iotek 7010, Iotek 8000 and the like. These ionomer resins may be used alone or in combination.

As the materials suitably used in the cover 3 of the present invention, the above ionomer resin may be used alone, but the ionomer resin may be used in combination with at least one of thermoplastic elastomer, diene block copolymer and the like.

Examples of the thermoplastic elastomers include polyamide thermoplastic elastomer, which is commercially available from Toray Co., Ltd. under the trade name of "Pebax" (such as "Pebax 2533S"); polyester thermoplastic elastomer, which is commercially available from Toray-Do Pont Co., Ltd. under the trade name of "Hytrel" (such as "Hytrel 3548", "Hytrel 4047"); polyurethane elastomer, which is commercially available from Takeda Verdishe Co., Ltd. under the trade name of "Elastoran" (such as "Elastoran ET880"); and the like.

The diene block copolymer is a block copolymer or partially hydrogenated block copolymer having double bond derived from conjugated diene compound. The base bock copolymer is block copolymer composed of block polymer block A mainly comprising at least one aromatic vinyl compound and polymer block B mainly comprising at least one conjugated diene compound. The partially hydrogenated block copolymer is obtained by hydrogenating the block copolymer. Examples of the aromatic vinyl compounds comprising the block copolymer include styrene, α-methyl styrene, vinyl toluene, p-t-butyl styrene, 1,1-diphenyl styrene and the like, or mixtures thereof. Preferred is styrene. Examples of the conjugated diene compounds include butadiene, isoprene, 1,3-pentadiene, 2,3-dimethyl-1,3-butadiene and the like, or mixtures thereof. Preferred are butadiene, isoprene and combinations thereof. Examples of the diene block copolymers which is commercially available include the diene block copolymers, which are commercially available from Daicel Chemical Industries, Ltd. under the trade name of "Epofriend" (such as "Epofriend A1010") and the like.

The amount of the thermoplastic elastomer or diene block copolymer is 5 to 40 parts by weight, preferably 10 to 30 parts by weight, based on 100 parts by weight of the base resin for the cover. When the amount is smaller than 5 parts by weight, the technical effect of improving the shot feel at the time of hitting accomplishing by using them can not be sufficiently obtained. On the other hand, when the amount is larger than 40 parts by weight, the cover is too soft and the rebound characteristics are degraded, or the compatibility with the ionomer resin is degraded and the durability is degrade.

The composition for the cover 3 used in the present invention may optionally contain the same fillers used in the core, pigments (such as titanium dioxide, etc.) and the other additives such as a dispersant, an antioxidant, a UV absorber, a photostabilizer and a fluorescent agent or a fluorescent brightener, etc., in addition to the resin component, as long as the addition of the additives does not deteriorate the desired performance of the golf ball cover.

A method of covering on the core 2 with the cover 3 is not specifically limited, but may be a conventional method. For example, there can be used a method comprising molding the cover composition into a semi-spherical half-shell in advance, covering the core, which is covered with the outer core, with the two half-shells, followed by pressure molding at 130 to 170° C. for 1 to 5 minutes, or a method comprising injection molding the cover composition directly on the core, which is covered with the core, to cover it. At the time of molding the cover, many depressions called "dimples" may be optionally formed on the surface of the golf ball. Furthermore, paint finishing or marking with a stamp may be optionally provided after the cover molded for commercial purposes.

EXAMPLES

The following Examples and Comparative Examples further illustrate the present invention in detail but are not to be construed to limit the scope of the present invention.

(i) Production of semi-vulcanized semi-spherical half-shell for the core

The rubber compositions for the core having the formulation shown in Tables 1 (Examples) and 2 (Comparative Examples) were mixed, and then press-molded at 140° C. for 5 minutes in the mold (4, 5) as described in FIG. 2 to obtain a semi-vulcanized semi-spherical half-shell 6 for the core. The mold is composed of a mold having a semi-spherical cavity 4 and the male plug mold 5 having a semi-spherical convex having the same diameter as the hollow portion, of which the diameter are shown in Tables 3 (Examples) and 4 (Comparative Examples).

(ii) Production of hollow core

The two semi-vulcanized semi-spherical half-shells 6 for the core produced in the step (i) were then vulcanized by press-molding at the vulcanization condition shown in Tables 1 (Examples) and 2 (Comparative Examples) in the mold 7 described in FIG. 3 to obtain hollow cores 2 having the diameter shown in Tables 1 (Examples) and 2 (Comparative Examples).

(iii) Preparation of cover compositions

The formulation materials shown in Tables 1 (Examples) and 2 (Comparative Examples) were mixed using a kneading type twin-screw extruder to obtain pelletized cover compositions. The extrusion condition was, a screw diameter of 45 mm, a screw speed of 200 rpm, and a screw L/D of 35.

The formulation materials were heated at 150 to 260° C. at the die position of the extruder.

TABLE 1

(parts by weight)

| | Example No. | | | | |
|---|---|---|---|---|---|
| | 1 | 2 | 3 | 4 | 5 |
| (Core composition) | | | | | |
| BR-18*1 | 100 | 100 | 100 | 100 | 100 |
| Zinc acrylate | 30 | 30 | 30 | 30 | 30 |
| Zinc oxide | 8.6 | 11 | 11 | 3 | 11 |
| Dicumyl peroxide | 0.5 | 0.5 | 0.5 | 0.5 | 0.5 |
| Diphenyl disulfide | 0.5 | 0.5 | 0.5 | 0.5 | — |
| Vulcanization condition | | | | | |
| (° C.) | 165 | 165 | 165 | 165 | 165 |
| (min) | 24 | 24 | 24 | 24 | 24 |
| (Cover composition) | | | | | |
| Hi-milan 1555*2 | — | — | 45 | — | — |
| Hi-milan 1605*3 | — | — | — | — | — |
| Hi-milan 1706*4 | — | — | — | — | — |
| Hi-milan 1707*5 | — | — | — | — | — |
| Hi-milan 1855*6 | 10 | 10 | — | 10 | 10 |
| Surlyn 8945*7 | 34 | 34 | 15 | 34 | 34 |
| Surlyn 9945*8 | 46 | 46 | — | 46 | 46 |
| Surlyn AD8542*9 | — | — | 20 | — | — |
| Pebax 2533*10 | 7 | 7 | 12 | 7 | 7 |
| Epofriend A1010*11 | 3 | 3 | 8 | 3 | 3 |

TABLE 2

(parts by weight)

| | Comparative Example No. | | | | | |
|---|---|---|---|---|---|---|
| | 1 | 2 | 3 | 4 | 5 | 6 |
| (Core composition) | | | | | | |
| BR-18*1 | 100 | 100 | 100 | 100 | 100 | 100 |
| Zinc acrylate | 30 | 30 | 34 | 30 | 30 | 30 |
| Zinc oxide | 11 | 11 | 9.4 | 28.5 | 8.1 | 24.9 |
| Dicumyl peroxide | 0.5 | 0.5 | 0.5 | 0.5 | 0.5 | 0.5 |
| Diphenyl disulfide | 0.5 | 0.5 | 0.5 | 0.5 | 0.5 | 0.5 |
| Vulcanization condition | | | | | | |
| (° C.) | 165 | 165 | 165 | 165 | 165 | 165 |
| (min) | 24 | 24 | 24 | 24 | 24 | 24 |
| (Cover composition) | | | | | | |
| Hi-milan 1555*2 | — | — | — | — | — | — |
| Hi-milan 1605*3 | — | 40 | — | — | — | — |
| Hi-milan 1706*4 | — | 30 | — | — | — | — |
| Hi-milan 1707*5 | — | 40 | — | — | — | — |
| Hi-milan 1855*6 | 10 | — | 10 | 10 | 10 | 10 |
| Surlyn 8945*7 | 34 | — | 34 | 34 | 34 | 34 |
| Surlyn 9945*8 | 46 | — | 46 | 46 | 46 | 46 |
| Surlyn AD8542*9 | — | — | — | — | — | — |
| Pebax 2533*10 | 7 | — | 7 | 7 | 7 | 7 |
| Epofriend A1010*11 | 3 | — | 3 | 3 | 3 | 3 |

*1: BR-18 (trade name), polybutadiene available from JSR Co., Ltd.

*2: Hi-milan 1555 (trade name), ethylene-methacrylic acid copolymer ionomer resin obtained by neutralizing with sodium ion, manufactured by Mitsui Du Pont Polychemical Co., Ltd.

*3: Hi-milan 1605 (trade name), ethylene-methacrylic acid copolymer ionomer resin obtained by neutralizing with sodium ion, manufactured by Mitsui Du Pont Polychemical Co., Ltd.

*4: Hi-milan 1706 (trade name), ethylene-methacrylic acid copolymer ionomer resin obtained by neutralizing with zinc ion, manufactured by Mitsui Du Pont Polychemical Co., Ltd.

*5: Hi-milan 1707 (trade name), ethylene-methacrylic acid copolymer ionomer resin obtained by neutralizing with sodium ion, manufactured by Mitsui Du Pont Polychemical Co., Ltd.

*6: Hi-milan 1855 (trade name), ethylene-methacrylic acid-isobutyl acrylate terpolymer ionomer resin obtained by neutralizing with zinc ion, manufactured by Mitsui Du Pont Polychemical Co., Ltd.

*7: Surlyn 8945 (trade name), ethylene-methacrylic acid copolymer ionomer resin obtained by neutralizing with sodium ion, manufactured by DuPont USA Co.

*8: Surlyn 9945 (trade name), ethylene-methacrylic acid copolymer ionomer resin obtained by neutralizing with zinc ion, manufactured by Du Pont Co.

*9: Surlyn AD8542 (trade name), ethylene-methacrylic acid copolymer ionomer resin obtained by neutralizing with magnesium ion, manufactured by Du Pont Co.

*10: Pebax 2533 (trade name), polyether amide thermoplastic elastomer, manufactured by ELF Atochem Co.

*11: Epofriend AT1010 (trade name), styrene-butadiene-styrene (SBS) block copolymer with epoxy groups, manufactured by Daicel Chemical Industries, Ltd., JIS-A hardness=67, styrene/butadiene (weight ratio)=40/60, content of epoxy=about 1.5 to 1.7% by weight Examples 1 to 5 and Comparative Examples 1 to 4

The cover composition prepared in the step (iii) was covered on the resulting core 4 produced in the step (ii) by injection molding to form a cover layer 3 having the thickness shown in Tables 3 (Examples) and 4 (Comparative Examples). Then, paint was applied on the surface to produce golf ball having the diameter shown in the tables. With respect to the resulting golf balls, the deformation amount, moment of inertia, flight performance (launch angle, initial spin amount, carry and straightness) and shot feel were measured or evaluated. The results are shown in Tables 3 (Examples) and 4 (Comparative Examples). The test methods are described later.

Comparative Examples 5 and 6

(a) Preparation of solid core

The rubber compositions for the core having the formulation shown in Table 2 (Comparative Examples) were mixed, and then press-molded at the vulcanization condition shown in the same Table in a mold, which is composed of an upper mold and a lower mold having a semi-spherical cavity, to obtain solid cores having the diameter shown in the same Table.

(b) Production of golf ball

Solid golf balls having the diameter shown in Table 4 were produced as described in Examples 1 to 12 and Comparative Examples 1 to 4 except for using the solid core in place of using the hollow core. With respect to the resulting golf balls, the deformation amount, moment of inertia, flight performance (launch angle, initial spin amount, carry and straightness) and shot feel were measured or evaluated. The results are shown in Table 4. The test methods are as follows.

(Test method)

(1) Shore D hardness of cover

After the golf ball is obtained by covering the core with the cover, a Shore D hardness of the cover is determined by measuring a hardness at the surface of the golf ball using a Shore D hardness meter according to ASTM-D2240-68.

(2) Moment of inertia

The moment of inertia was measured by INERTIA DYNAMICS MODEL MOI-005-002, available from INERTIA DYNAMICS Co.

(3) Flight performance

A No. 1 wood club (a driver, W#1) was mounted to a swing robot manufactured by True Temper Co. and the resulting golf ball was hit at a head speed of 45 m/sec, the launch angle, flight distance and initial spin amount were measured. The launch angle was determined by measuring a launch angle immediately after hitting using a sensor. As the flight distance, carry that is a distance to the dropping point of the hit golf ball was measured. The initial spin amount was measured spin amount immediately after hitting by continuously taking a photograph of a mark provided on the hit golf ball using a high-speed camera.

(4) Straightness

A No. 1 wood club (a driver, W#1) was mounted to a swing robot manufactured by True Temper Co. and the resulting golf ball was hit at a head speed of 45 m/sec with a club face open, so that the golf ball has side spin amount of 500 rpm and is sliced. The straightness is determined by measuring a distance of the dropping point from the objective direction of flight. The smaller the distance is, the more excellent the straightness is.

(5) Shot feel

The shot feel of the resulting golf ball was evaluated by 10 top professional golfers according to practical hitting test by a driver. The evaluation criteria are as follows. "o-Δ" shown in the Table refers to the result that there are both golfers evaluated the golf ball as "o" and golfers evaluated the golf ball as "Δ" in the 10 golfers.

(Evaluation criteria)

o: Soft and good

Δ: Fairly good x: Hard and poor

TABLE 3

(Test results)

| Test item | Example No. 1 | 2 | 3 | 4 | 5 |
|---|---|---|---|---|---|
| Diameter of core (mm) | 39.7 | 39.7 | 39.7 | 41.0 | 39.7 |
| Diameter of hollow portion (mm) | 5.0 | 10.0 | 10.0 | 15.0 | 10.0 |
| Thickness of cover (mm) | 2.0 | 2.0 | 2.0 | 2.0 | 2.0 |
| Shore D hardness of cover (mm) | 64 | 64 | 57 | 64 | 57 |
| Diameter of golf ball | | | | | |
| cm | 43.7 | 43.7 | 43.7 | 45.0 | 43.7 |
| inch | 1.72 | 1.72 | 1.72 | 1.77 | 1.72 |
| Deformation amount of golf ball (mm) | 2.76 | 3.01 | 3.09 | 3.30 | 2.72 |
| Moment of inertia | 85.3 | 86.7 | 86.4 | 88.0 | 86.7 |

TABLE 3-continued

| Test item | (Test results) Example No. 1 | 2 | 3 | 4 | 5 |
|---|---|---|---|---|---|
| of golf ball (g · cm$^2$) | | | | | |
| Flight performance (W#1, 45 m/sec) | | | | | |
| Launch angle (degree) | 11.1 | 11.3 | 11.2 | 11.4 | 11.0 |
| Spin amount (rpm) | 2790 | 2710 | 2770 | 2650 | 2820 |
| Carry (yard) | 230.3 | 231.4 | 230.2 | 229.2 | 227.5 |
| Straightness (yard) | 21.3 | 20.5 | 20.6 | 19.5 | 19.6 |
| Shot feel | ○–Δ | ○ | ○ | ○–Δ | ○–Δ |

TABLE 4

| Test item | Comparative Example No. 1 | 2 | 3 | 4 | 5 | 6 |
|---|---|---|---|---|---|---|
| Diameter of core (mm) | 39.1 | 39.7 | 39.7 | 38.7 | 39.7 | 39.7 |
| Diameter of hollow portion (mm) | 10.0 | 10.0 | 10.0 | 10.0 | — | — |
| Thickness of cover (mm) | 2.3 | 2.0 | 2.0 | 2.0 | 2.0 | 2.0 |
| Shore D hardness of cover (mm) | 64 | 70 | 64 | 64 | 64 | 64 |
| Diameter of golf ball | | | | | | |
| cm | 43.7 | 43.7 | 43.7 | 42.7 | 43.7 | 42.7 |
| inch | 1.72 | 1.72 | 1.72 | 1.68 | 1.72 | 1.68 |
| Deformation amount of golf ball (mm) | 2.92 | 2.77 | 2.50 | 2.85 | 2.97 | 2.80 |
| Moment of inertia of golf ball (g · cm$^2$) | 86.5 | 86.4 | 86.4 | 83.0 | 84.8 | 80.5 |
| Flight performance (W#1, 45 m/sec) | | | | | | |
| Launch angle (degree) | 11.2 | 11.4 | 11.0 | 11.0 | 11.1 | 10.8 |
| Spin amount (rpm) | 2790 | 2630 | 2810 | 2830 | 2790 | 2900 |
| Carry (yard) | 229.0 | 228.5 | 227.0 | 226.5 | 227.3 | 225.3 |
| Straightness (yard) | 20.3 | 21.0 | 20.3 | 25.0 | 21.2 | 26.3 |
| Shot feel | Δ–x | x | x | ○ | Δ | Δ |

As is apparent from the results shown in Tables 3 and 4, the golf balls of Examples 1 to 5 of the present invention obtained by placing a hollow portion at the center of the core and adjusting the diameter, moment of inertia and deformation amount of the golf ball to a specified range, when compared with the golf balls of Comparative Examples 1 to 6, are superior in flight distance, straightness and shot feel. In the golf ball of Example 5 comprising no organic sulfide compound in the core, the rebound characteristics are degraded, and the flight distance is slightly short in the golf balls of Examples.

On the other hand, in the golf ball of Comparative Example 1, the cover thickness is large, and the shot feel is hard and poor. In the golf ball of Comparative Example 2, the cover hardness is large, and the shot feel is hard and poor. In the golf ball of Comparative Example 3, the deformation amount is small, and the shot feel is hard and poor. In the golf ball of Comparative Example 4, the moment of inertia is not largely degraded because of the technical effect of the hollow portion, but the straightness is very poor, because the diameter is small. In the golf ball of Comparative Example 5, the shot feel is hard and poor, because of the absence of a hollow portion. In the golf ball of Comparative Example 6, the shot feel is hard and poor because of the absence of a hollow portion, the straightness is very poor because the diameter is small, and the spin amount at the time of hitting is large, which largely reduces the flight distance, because the moment of inertia is small.

What is claimed is:

1. A hollow solid golf ball comprising a core having a hollow portion at the center of the core and a cover formed on the core, wherein the golf ball has a diameter of 42.92 to 45.47 mm, a moment of inertia of 83 to 105 g·cm$^2$, and a deformation amount of 2.6 to 4.0 mm, when applying from an initial load of 10 kgf to a final load of 130 kgf.

2. The hollow solid golf ball according to claim 1, wherein the golf ball has a moment of inertia of 85 to 88 g·cm$^2$.

3. The hollow solid golf ball according to claim 1, wherein the cover has a thickness of 1.0 to 2.1 mm and a Shore D hardness of 50 to 64.

4. The hollow solid golf ball according to claim 1, wherein the core is formed from a vulcanized molded article of a rubber composition comprising polybutadiene, a co-crosslinking agent, an organic peroxide, an organic sulfide compound and a filler, and the amount of the organic sulfide compound is 0.2 to 3.0 parts by weight, based on 100 parts by weight of the polybutadiene.

5. The hollow solid golf ball according to claim 1, wherein the golf ball has a diameter of 43.18 to 45.47 mm.

* * * * *